US007267084B2

(12) United States Patent
Lütze et al.

(10) Patent No.: US 7,267,084 B2
(45) Date of Patent: Sep. 11, 2007

(54) COOLING AND PREHEATING DEVICE

(75) Inventors: Roland Lütze, Leonberg (DE); Heiko Sass, Tamm (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 11/334,045

(22) Filed: Jan. 18, 2006

(65) Prior Publication Data

US 2006/0157000 A1 Jul. 20, 2006

Related U.S. Application Data

(63) Continuation-in-part of application No. PCT/EP2004/007772, filed on Jul. 14, 2004.

(30) Foreign Application Priority Data

Jul. 19, 2003 (DE) ..... 103 32 949

(51) Int. Cl.
*F01P 7/14* (2006.01)
*F01P 5/10* (2006.01)

(52) U.S. Cl. ..... 123/41.02; 123/41.44; 123/41.33; 123/41.29

(58) Field of Classification Search ..... 123/41.33, 123/41.47, 41.29, 196 AB, 41.02, 41.44
See application file for complete search history.

(56) References Cited

U.S. PATENT DOCUMENTS 4,196,847 A * 4/1980 Gobien ..... 236/34.5
5,121,714 A * 6/1992 Susa et al. ..... 123/41.1
5,215,044 A 6/1993 Banzhaf et al.
6,053,131 A 4/2000 Mueller et al.
6,196,168 B1 * 3/2001 Eckerskorn et al. ..... 123/41.33
6,595,164 B2 * 7/2003 Kunze et al. ..... 123/41.1
6,668,764 B1 * 12/2003 Henderson et al. ..... 123/41.29
6,772,715 B2 * 8/2004 Pfeffinger et al. ..... 123/41.31
6,955,141 B2 * 10/2005 Santanam et al. ..... 123/41.08
7,124,715 B2 * 10/2006 Hutchins ..... 123/41.1
2006/0157002 A1 * 7/2006 Pfeffinger et al. ..... 123/41.29

FOREIGN PATENT DOCUMENTS

DE 196 37 817 3/1998

* cited by examiner

*Primary Examiner*—Stephen K. Cronin
*Assistant Examiner*—Ka Chun Leung
(74) *Attorney, Agent, or Firm*—Klaus J. Bach

(57) ABSTRACT

In a cooling and heating device for an internal combustion engine having a main coolant pump supplying coolant to the engine and a coolant return line with a return flow control unit which directs the coolant return flow to the main coolant pump selectively via a large cooling circuit, in which an air/fluid cooler is arranged, or via a small cooling circuit bypassing the air/fluid cooler, an oil/coolant heat exchanger is provided for heating or cooling a flow of oil, the flow of coolant through the oil/coolant heat exchanger being controlled by means of a coolant flow control unit directing the flow through the oil/coolant heat exchanger only after a predefined coolant temperature has been reached so that, below this temperature, no heat is extracted from the coolant by the oil/coolant heat exchanger and rapid heating of the internal combustion engine is ensured.

7 Claims, 2 Drawing Sheets

COOLING AND PREHEATING DEVICE

This is a Continuation-In-Part Application of International Application PCT/EP2004/007772 filed Jul. 14, 2004 and claiming the priority of German Application 103 32 949.8 filed Jul. 19, 2003.

BACKGROUND OF THE INVENTION

The invention relates to a device for an internal combustion engine having a main coolant pump supplying coolant to the internal combustion engine including a large cooling circuit with an air/coolant heat exchanger and a small cooling circuit by-passing the air/fluid heat exchanger and a coolant/oil heat exchanger which bypasses the air/coolant heat exchanger and a coolant/oil heat exchanger for heating or cooling the oil of a transmission of the internal combustion engine.

DE 196 37 817 C1 discloses a device and a method for cooling and preheating in particular transmission oil in internal combustion engines. The device has a cooling circuit including a coolant pump, and an air/fluid cooler which can be connected into the cooling circuit by means of an engine thermostat when a specific temperature is reached. Furthermore, the device has a heat exchanger through which a coolant of the cooling circuit of the internal combustion engine and transmission oil flow. This heat exchanger can be used to heat and to cool the transmission oil. In order to heat the transmission oil, a control unit branches off a flow of coolant from a main cooling circuit of the internal combustion engine, said flow of coolant transferring thermal energy to the transmission oil in the heat exchanger. In the cooling phase, the control unit feeds a flow of coolant for cooling the transmission oil from a low temperature cooler into the heat exchanger. The control unit has two thermostats, one thermostat ensuring that the hot flow of coolant for heating the transmission oil is regulated, i.e. the thermostat is opened at a cold coolant temperature and closes at a predetermined, higher temperature. In the case of cooling, the other thermostat regulates the flow of coolant coming from the low temperature part of the water cooler in such a way that a predefined constant transmission oil temperature can be realized. At a low coolant temperature, this thermostat is closed and opens at a predeterminable higher temperature.

It is the object of the present invention to provide a device for cooling and heating transmission oil in internal combustion engines which has a simplified design compared to the prior art and which improves the heating of the internal combustion engine after a cold start.

SUMMARY OF THE INVENTION

In a cooling and heating device for an internal combustion engine having a main coolant pump supplying coolant to the engine and a coolant return line with a return flow control unit which directs the coolant return flow to the main coolant pump selectively via a large cooling circuit, in which an air/fluid cooler is arranged, or via a small cooling circuit bypassing the air/fluid cooler, an oil/coolant heat exchanger is provided for heating or cooling a flow of oil, the flow of coolant through the oil/coolant heat exchanger being controlled by means of a coolant flow control unit directing the flow through the oil/coolant heat exchanger only after a predefined coolant temperature has been reached so that, below this temperature, no heat is extracted from the coolant by the oil/coolant heat exchanger and rapid heating of the internal combustion engine is ensured.

Starting at a predeterminable temperature, the second control unit enables the coolant flow through the second heat exchanger. The coolant which flows through the heat exchanger and the second control unit is branched off from a coolant return flow line of the internal combustion engine. The control unit may be of automatically switching design or be capable of being actuated electrically by a control unit.

In one refinement of the invention, the second control unit is embodied as a thermostat. The thermostat has a first and second inflow port and return flow port. An expansion element, which changes its length depending on the temperature, closes off the first inflow by means of a first valve disk up to a predeterminable temperature. If this temperature is exceeded, the first valve disk lifts off and opens the first inflow, and a second valve disk closes the second inflow. In a transition phase, the coolant flows briefly through both inflows.

In a further refinement of the invention, a heating circuit line is provided through which coolant which is branched off the coolant return line flows, and in which a heat exchanger for heating the passenger compartment is arranged. Coolant flows through the heat exchanger for heating the passenger compartment. Air which flows through the heat exchanger extracts thermal energy from the coolant and feeds it to the passenger compartment. Heat is regulated either by controlling the flow of coolant or by controlling the flow of air through the heat exchanger. The return flow line of the heat exchanger is preferably connected to the second control unit and/or to the second heat exchanger in order to heat the passenger compartment.

In a further refinement of the invention, an exhaust gas recirculation cooler is arranged in the heating circuit line. On the one hand, the re-circulated exhaust gas flows through the heat exchanger for exhaust gas recirculation and on the other hand coolant flows through the heat exchanger, as a result of which the exhaust gas is cooled before it reaches the combustion chamber. The cooling of the re-circulated exhaust gas reduces the proportion of nitrogen oxide in the emissions of the internal combustion engine.

In a further refinement of the invention, the second control unit has a bypass bore in a valve disk through which, in a phase in which the flow of oil is to be cooled, the coolant which flows back from the heating circuit line flows back to the main coolant pump essentially via the bypass bore, and the coolant which flows back from the low temperature region of the air/fluid cooler flows back to the main coolant pump via the second heat exchanger. The second valve disk is arranged in such a way that it can close off an inflow into the second control unit from the air/fluid cooler and from the heating circuit line. A bypass bore in the second valve disk is embodied in such a way that, in a phase in which the flow of oil is to be cooled, a large proportion of the coolant which flows from the low temperature region of the air/fluid cooler flows into the second heat exchanger, and the warm coolant from the heating circuit line flows back to the intake side of the main coolant pump essentially via the bypass bore. This division of the flow of coolant can be brought about by adjusting the throttle cross sections of the coolant lines involved.

In another refinement of the invention, the second heat exchanger is a transmission oil cooler. Both, the transmission oil and the coolant flow through the heat exchanger. If the transmission oil is cooled, it gives off thermal energy to the coolant. For heating the transmission oil, the coolant gives off heat to the transmission oil.

In a further refinement of the invention, the internal combustion engine has two essentially separate coolant circuits, one including the engine block and the other including the cylinder head, the flow through which coolant circuits is controlled by a flow control unit depending on the coolant temperature, coolant pressure, combustion chamber temperature, exhaust gas temperature, exhaust gas values, component temperature, oil temperature, passenger compartment temperature and/or ambient temperature. This flow control unit can be embodied as a heated or unheated thermostatic valve, an electrically actuated butterfly valve, a solenoid valve or as an electrically actuated rotary slide valve. Electrically actuated valves are activated by means of a control unit. The control unit processes the abovementioned temperature values, exhaust gas values and pressure values sensed by sensors and calculates when the flow control unit is switched with respect to emission values and consumption values. The pressure-dependent control of the flow through the engine block and/or the cylinder head can also be provided by a pressure valve. The pressure valve can be used alone or in combination with the previously mentioned valves.

In a further refinement of the invention, a main coolant pump is driven mechanically and can be switched on and off by means of a clutch. The main coolant pump is operatively connected to the crankshaft so as to be driven thereby. The drive is provided by means of a belt drive or positively locking elements such as, for example, gearwheels. In order to prevent the flow of coolant in the warming up phase of the internal combustion engine, the main coolant pump can be switched off. The switching off process is carried out by means of a clutch which can be implemented as a magnetic clutch, as a viscous clutch or as a clutch which is to be opened and closed by means of frictional engagement or positively locking engagement.

In a further refinement of the invention, an electric additional coolant pump is arranged in the heating circuit line. Depending on the necessary flow of coolant, the electric additional coolant pump is used in addition to the main coolant pump or instead of the switched-off main coolant pump. The rotational speed of the additional coolant pump can be controlled and/or said additional coolant pump can be switched on and off in a clocked fashion so that a flow of coolant which corresponds to demand can be established.

Further features and feature combinations will become apparent from the description on the basis of the accompanying drawings.

DESCRIPTION OF PARTICULAR EMBODIMENTS

In the text which follows identical components in FIGS. 1 to 4 are designated by the same reference symbols.

Figure 1:
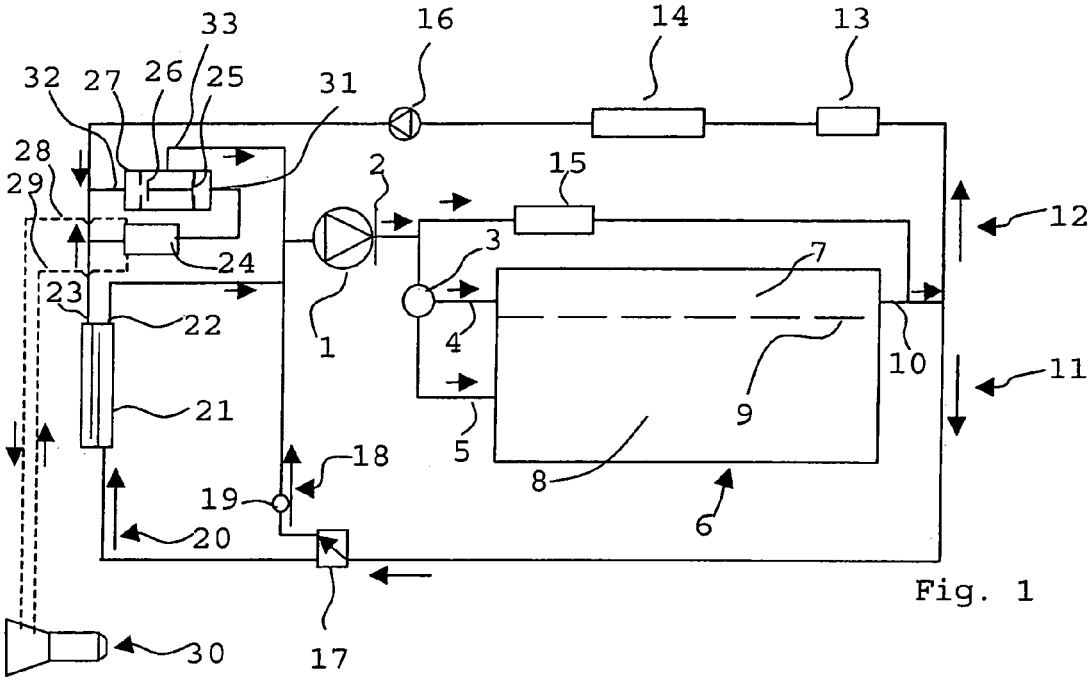
FIG. 1 is a schematic illustration of a device according to the invention for preheating and cooling the transmission oil in a switching circuit below a first coolant temperature (for example <70° C.)

The schematic illustration in FIG. 1 shows an internal combustion engine 6 which is provided with a cooling circuit. The direction of flow of a coolant in the cooling circuit is indicated by an arrow at various points. The coolant which circulates in the cooling circuit flows from the main coolant pump 1 through the various components as described below.

The main coolant pump 1, which is operatively connected to a crankshaft (not shown) of the internal combustion engine 6, circulates the cooling fluid in the cooling circuit. In the embodiment shown, the main coolant pump 1 can be decoupled mechanically. The drive for the main coolant pump 1 is provided by means of a belt, i.e. a V belt or a toothed belt or by means of gearwheels.

By activating a clutch 2 the main coolant pump can be disconnected from the drive. The clutch 2 can be actuated electrically.

In a modified embodiment (not shown), the main coolant pump 1 is an electric pump whose rotational speed can be regulated from zero to the maximum rotational speed. In this embodiment there is no need for a mechanical coupling 2 to switch off the main coolant pump 1. Furthermore, the electric main coolant pump 1 can be operated independently of the engine speed. The pump can thus be operated such that it supplies precisely the necessary amount of coolant.

From the main coolant pump 1 the coolant flows to a first flow control unit 3. The first flow control unit 3 is connected to two inflow ports of an internal combustion engine. Depending on the operating state, the first flow control unit 3 feeds the coolant to the cylinder head 7 and/or to the engine block 8. The flow control unit 3 is, for example, an electrically actuated valve.

The internal combustion engine 6 generates both mechanically usable energy and a high proportion of excess thermal energy by burning an air mixture. In order to avoid overheating of the internal combustion engine 6, a coolant which flows through the internal combustion engine 6 absorbs the excess heat and outputs it to the surroundings via an air/fluid cooler 21. In the embodiment shown, coolant is exchanged between the engine block 8 and the cylinder head 7 via a cylinder head gasket 9. If the first flow control unit 3 admits coolant only to the inlet for the engine block 8, the coolant flows into the engine block 8 and then into the cylinder head 7 via the opening in the cylinder head gasket 9, and out of the internal combustion engine 6 via a return flow line 10 of the cylinder head 7. If the first flow control unit 3 admits coolant only to the cylinder head 7, the coolant flows to the return flow line 10 only through the cylinder head 7. If the first flow control unit 3 admits coolant to the cylinder head 7 and to the engine block 8, part of the coolant flows to the return flow line 10 via the engine block 8 and the cylinder head 7, and the other part flows to the return flow line 10 only through the cylinder head 7.

In a modified embodiment (not illustrated), the internal combustion engine 6 has completely separate cooling circuits in the engine block 8 and in the cylinder head 7, i.e. there is no exchange of coolant via the cylinder head gasket 9. The engine block 8 and cylinder head 7 then each have a return flow opening for the coolant. The coolant flowing out of the two return flow openings collects in a common line 10 which leads on. The flow of coolant emerging from the internal combustion engine flows partially into a heating circuit line 12 and partially into a cooling circuit 11.

As shown in FIG. 1, the heating circuit line 12 includes an exhaust gas recirculation cooler 13 arranged downstream of the internal combustion engine 6. Exhaust gas recirculation coolers 13 are used in diesel engines. As a result of the cooling of the exhaust gas which is returned to the combustion chambers, the combustion temperature, and thus the $NO_x$ content of the exhaust gas, are reduced. In the exhaust gas recirculation cooler 13, the exhaust gases which have a high temperature transfer thermal energy to the coolant.

Furthermore, a heat exchanger 14 which serves to heat a passenger compartment is arranged in the heating circuit line 12 downstream of the exhaust gas recirculation cooler 13. When heating of the passenger compartment is requested, the heat exchanger 14 extracts thermal energy from the coolant and feeds said thermal energy to the passenger compartment.

The engine lubricating oil absorbs some of the waste heat of an internal combustion engine 6. In relatively powerful engines, it is no longer sufficient to cool the lubricating oil only by way of an oil sump in order to maintain the maximum permissible lubricating oil temperature. Rather, an engine oil/coolant heat exchanger, referred to below as an engine oil cooler 15, is used to extract heat from the lubricating oil and transfer it to the coolant. In FIG. 1, the coolant feed line of the engine oil cooler 15 branches off downstream of the main coolant pump 1 and upstream of the first flow control unit 3, and the return flow line extends to a coolant return flow line of the internal combustion engine 6.

In further modified embodiments (not shown), the engine oil cooler 15 can be arranged at different locations in the cooling circuit such as, for example, in the heating circuit line 12, in a line extending parallel to the cylinder head 7 or in a line extending parallel to the engine block 8.

In a modified embodiment (not shown), an air/water charge air cooler is arranged in the cooling circuit of a supercharged engine. The increase in density achieved by cooling the supercharged air provides for a higher power output because of an improved cylinder charge. Furthermore, the lower charge air temperature reduces the thermal loading of the engine and leads to lower $NO_x$ emissions in the exhaust gas. From the intake air which is compressed in the supercharger thermal energy is transferred to the cooling fluid in the charge air cooler.

An additional coolant pump 16 is located downstream of the heat exchanger 14 for the passenger compartment in the direction of flow. The additional coolant pump 16 is operated electrically and can be switched on depending on the operating state. The use of an additional coolant pump 16 is preferably to be provided in combination with a mechanical engine-speed-dependent main coolant pump 1 which cannot be controlled. The circulation of coolant can then be controlled by means of the additional coolant pump 16 in accordance with the cooling demand of the internal combustion engine 6.

Some of the coolant emerging from the internal combustion engine 6 flows into a small cooling circuit 18 and into a large cooling circuit 20. The coolant flows from the return flow line 10 of the internal combustion engine 6 to a second flow control unit 17. Depending on the coolant temperature, the second flow control unit 17 feeds the coolant back to the intake side of the main coolant pump 1 in a large cooling circuit 20 via an air/fluid cooler 21 or via a small cooling circuit 18 by bypassing the air/fluid cooler 21. The second flow control unit 17 may have an expansion element which switches over from the small cooling circuit 18 to the large cooling circuit 20 starting from a specific coolant temperature. Alternatively, the second control unit 17 can also be heated or be embodied as an electrically actuated mixing valve.

The air/fluid cooler 21 has a return flow opening at a normal temperature region 22, and a return flow opening at a low temperature region 23, thereof. The coolant from the low temperature region remains longer in the air/fluid cooler 21 and therefore is cooled to a lower temperature than the coolant from the normal temperature region.

In the small cooling circuit 18, a differential pressure valve 19 is arranged between the second flow control unit 17 and the intake side of the main coolant pump 1. If the pressure downstream of the second flow control unit 17 is low at low coolant temperatures, the differential pressure valve 19 shuts off the flow. Starting from a certain minimum pressure, the differential pressure valve 19 opens and enables the flow in the direction of flow. Counter to the direction of flow shown in FIG. 1, the differential pressure valve 19 closes off the flow.

In addition to the internal combustion engine 1, a transmission 30 used in motor vehicles generates waste heat. In order to avoid overheating the transmission oil, it is cooled by means of a transmission oil cooler 24. Both, the coolant of the internal combustion engine 1 and transmission oil flow through said transmission oil cooler 24. In the transmission oil cooler 24, heat is exchanged between the transmission oil and the coolant. The coolant inflow to the transmission oil cooler 24 is connected to a return flow line 23 of the low temperature region of the air/fluid cooler 21 and to the return flow line of the heating circuit line 12, and the coolant return flow opening of the transmission oil cooler 24 is connected to a third flow control unit 27. The transmission 30 is connected to the transmission oil cooler 24 via the forward feed line 29 and the return flow line 28.

The third flow control unit 27 has a first inflow port 31, a second inflow port 32 and a return flow port 33. An expansion element (not shown) which changes its length depending on the temperature, closes off the first inflow port 31 by means of a first valve disk 25 up to a predetermined temperature. The coolant then flows into the third flow control unit 27 via the second inflow port 32 and back to the main coolant pump 1 via the return flow port 33. If this temperature is exceeded, the first valve disk 25 lifts off and opens the first inflow 31, and a second valve disk 26 closes the second inflow 32. The coolant then flows into the third flow control unit 27 via the first inflow port 31, and back to the main coolant pump 1 via the return flow port 33. The second valve disk 26 has a bypass opening 34 (shown in FIG. 4) through which a limited amount of coolant flows when the valve disk 26 is closed.

With the arrangement shown in FIG. 1 the flow of coolant through the internal combustion engine 1 can be influenced in accordance with the operating temperature in such a way that the engine emissions are reduced. When the internal combustion engine 1 is cold, cooling is not necessary and the main coolant pump 1 is switched off by means of the clutch 2. So that the passenger compartment can be heated at low external temperatures for reasons of comfort, the electric additional coolant pump 16 feeds coolant through the cylinder head 7 and the heating circuit line 12 when necessary. The flow through the engine block 8 is prevented by the first flow control unit 3. In the third flow control unit 27, the first valve disk 25 closes off the first inflow port 31 so that coolant cannot flow through the transmission oil cooler 24. The thermal energy of the coolant can therefore advantageously be used only to heat the passenger compartment. The differential pressure valve 19 prevents the coolant from flowing past the cylinder head 7 via the small cooling circuit 18 counter to the direction of flow shown and is not heated up. Switching off the main coolant pump 1 reduces the power loss caused by secondary accessories of the internal combustion engine, whereby fuel consumption and exhaust gas emissions are reduced. Since the coolant is not circulated, the engine oil can also heat up more quickly and the time in which high frictional losses occur because of the engine oil being cold is shortened. This makes a further contribution to reducing the fuel consumption and emissions after the cold start.

When the internal combustion engine 1 is further heated and there is a need to cool the cylinder head 7 because of high combustion chamber temperatures, the main coolant pump 1 switches on. Web sensors (not shown) arranged in the cylinder head between inlet valves and outlet valves of the internal combustion engine 1 measure the combustion chamber temperature and transfer the measurement values to a control unit (not shown) which triggers the switching on of the main cooling water pump. At the same time, the first flow control unit 3 directs coolant only to the cylinder head 7 and the engine oil in the engine block 8 can continue to warm up. So that the coolant warms up quickly, the second flow control unit 17 directs the coolant back to the intake side of the main coolant pump 1 via a small cooling circuit 18 by bypassing the air/fluid cooler 21. Alternatively, in this phase the additional coolant pump 16 can also perform the function of circulating the coolant while the main coolant pump 1 remains switched off. However, for this case the additional coolant pump 16 must be correspondingly larger. Here, the differential pressure valve 19 also prevents the coolant from flowing past the cylinder head 7 via the small cooling circuit 18 counter to the direction of flow shown.

If the further heating of the internal combustion engine 1 requires the engine block 8 to be cooled, the first control unit 3 also feeds coolant to the engine block 8. The flow of coolant through the engine block can be varied between zero and the maximum volume flow supplied by the coolant pumps. In this way it is possible to provide for different temperatures at the cylinder head 7 and engine block 8. The cylinder head 7 temperature or the temperature in the combustion chamber is preferably as low as possible so that low emission values can be achieved. The engine block 8 should have an operating temperature of approximately 80° C. so that frictional losses are low. Up to a temperature of approximately 70° C., there is no heater flow through the transmission oil cooler because of the position of the first valve disk 25 in the third flow control unit 27. Up to the temperature of 70° C., the thermal energy produced as a result of the combustion can be used exclusively for quickly heating up the internal combustion engine in order to achieve low fuel consumption and low emission values and heat up the passenger compartment for reasons of comfort.

Figure 2:
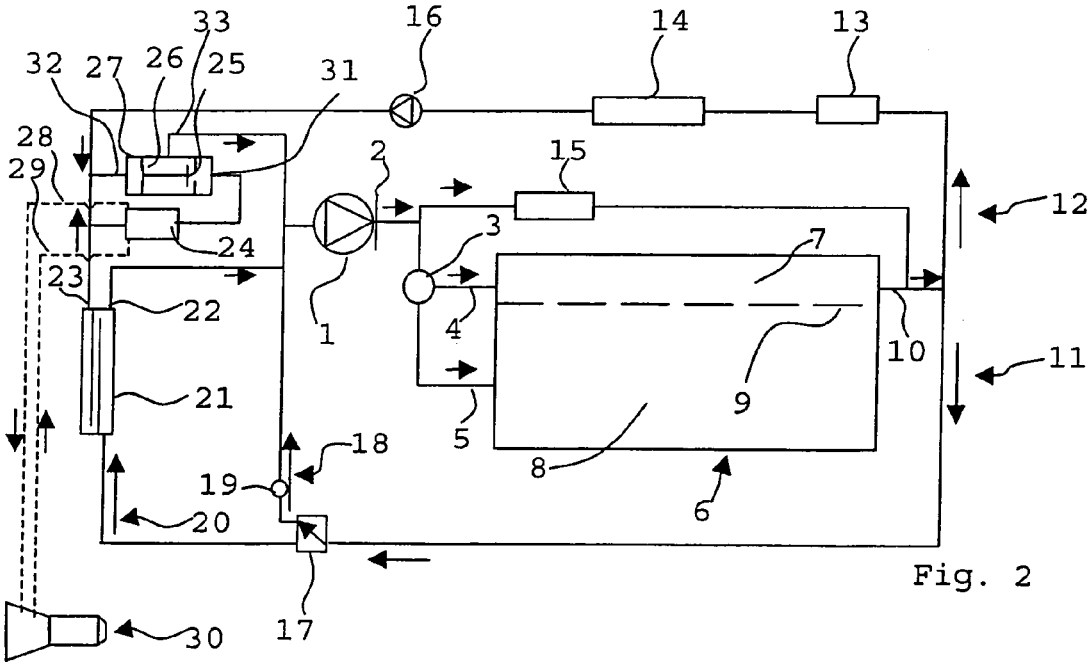
FIG. 2 shows the device of FIG. 1 in a switched position above the first coolant temperature (for example >70° C.)

Upon further heating sufficient thermal energy becomes available so that it is appropriate to use it to heat the oil of the transmission 30. The mechanical power loss is reduced as a result of the cold transmission oil being heated. As shown in FIG. 2, because of the expansion in length of the expansion element (not shown) above 70° C., the second inflow port 32 of the third flow control unit 27 is closed by the second valve disk 27 and the first inflow port 31 is opened. Coolant which returns from the heating circuit line flows through the transmission oil cooler 24, thus heating the transmission oil and reducing the mechanical losses of transmission. Furthermore there is no flow through the air/fluid cooler 21. Depending on how much thermal energy the exhaust gas recirculation cooler 13 and the heat exchanger 14 extract from the coolant to heat the passenger compartment, the temperature of the coolant leaving the internal combustion engine 6 at which the heating of the transmission oil is implemented shifts upwardly. Starting at a 70° C. outlet temperature of the coolant, the oil of the transmission 30 is heated if there is no request for heating the passenger compartment and the re-circulated exhaust gas is not cooled. When the passenger compartment heater is switched on, the transmission oil is heated, for example, only starting at 80° C. outlet temperature of the coolant. For reasons of passenger comfort, the heating of the passenger compartment again has priority over the heating of the transmission oil.

Figure 3:
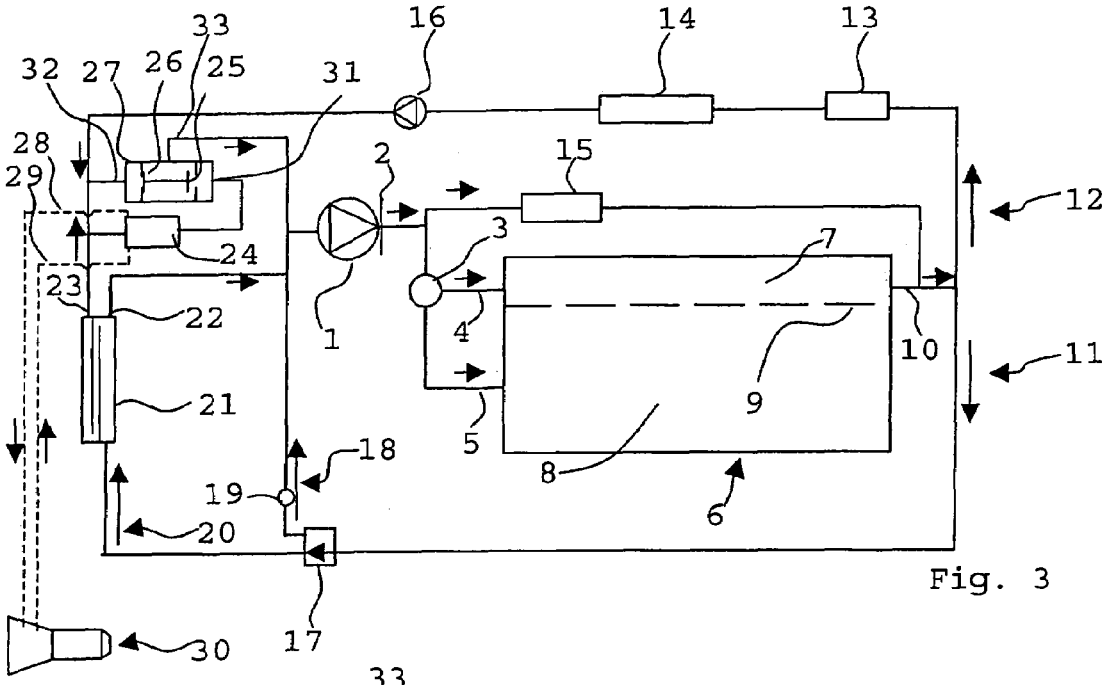
FIG. 3 shows the device of FIG. 1 in a switched position above a second coolant temperature (for example >92°)

As shown in FIG. 3, starting at a coolant temperature of approximately 92° C. the second flow control unit 17 directs the coolant to the air/fluid cooler 21 which comprises a normal temperature region 22 and a low temperature region 23. The coolant which emerges from the return flow opening of the normal temperature region 22 flows back to the main coolant pump 1. The coolant emerging from the return flow opening of the low temperature region 23 mixes with coolant from the heating circuit line 12 and flows back to the main coolant pump 1 via the transmission oil cooler 24, the third flow control unit 27 and return flow port 33 as a result of the position of the third flow control unit 27. Since the proportion of the volume flow of cold coolant is high compared to the proportion of volume flow of warm coolant through the gear transmission cooler 24, a good cooling capacity is obtained for the transmission oil.

Figure 4:
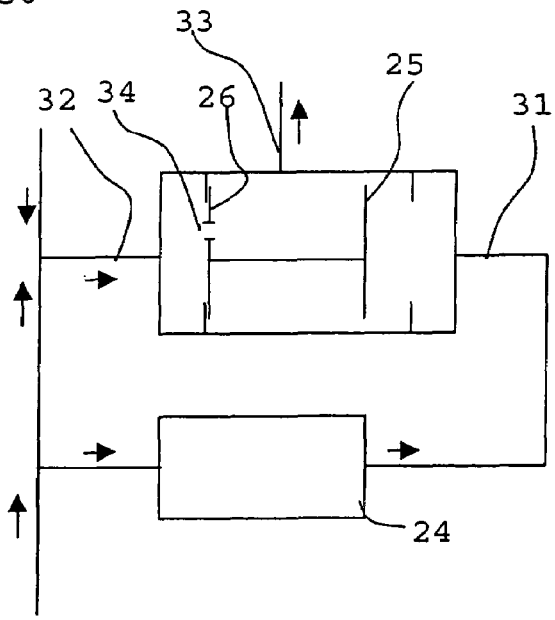
FIG. 4 shows an enlarged illustration of the second control unit (shown in FIG. 3) with a bypass bore.

As shown in FIG. 4, the second valve disk 26 has a bypass bore 34 through which the warm coolant preferably flows out of the heating circuit 12. As a result of selected various coolant line cross sections and of the diameter of the bypass bore 34, the coolant flowing out of the return flow opening from the low temperature region 23 of the air/fluid cooler 21 flows back to the main coolant pump 1 essentially via the transmission oil cooler 24, and the warm coolant from the heating circuit line 12 flows back to the main coolant pump 1 via the bypass bore 34. This specific arrangement and the selective adjustment make a further contribution to efficient cooling of the transmission oil.

The described device for cooling and heating the transmission oil can of course also be implemented with an air/fluid cooler 21 which has no low temperature region.

The switching temperatures of the control units mentioned in the exemplary embodiment are exemplary and can be shifted as desired depending on the application in order to optimize the entire system.

In a modified embodiment which is not shown, the main coolant pump 1 is embodied as an electric pump. The rotational speed thereof can be controlled from zero to the maximum rotational speed, i.e. in this embodiment there is no need for mechanical coupling 2 in order to switch off the main coolant pump 1. Furthermore, the electric main coolant pump 1 can be operated independently of the engine speed. The pump can be operated in such a way that it supplies precisely the necessary demand of coolant.

What is claimed is:

1. A cooling and heating device for an internal combustion engine (6) which has coolant inlet ports (4, 5) and a coolant return port (10), said device comprising a main coolant pump (1) for supplying a coolant to the internal combustion engine (6) via the coolant inlet ports (4, 5), a first flow control unit (3) for controlling the coolant flow to the coolant inlet ports (4, 5), a second flow control unit (17) arranged in a coolant return line (10) from the engine (6), said second flow control unit (17) directing the coolant, depending on the temperature thereof, to an inlet of the main coolant pump (1) either via a large cooling circuit (20) including an air/fluid cooler (21) or via a small cooling circuit (18) bypassing the air/fluid cooler (21), a transmission oil heat exchanger (24) through which both the coolant and transmission oil flow and a third coolant flow control unit (27) for controlling the coolant flow through the transmission oil heat exchanger in order to heat the transmission oil in the transmission oil heat exchanger (24), a coolant flow conduit extending from the return flow line (10) of the internal combustion engine (6) through the transmission oil heat exchanger (24) for heating the transmission oil and a coolant line extending from a return flow opening of a low-temperature region (23) of the air/fluid cooler (21) to the transmission oil heat exchanger (24) for transferring heat from the transmission oil to the coolant, said third flow control unit (27) directing the flow of coolant through the transmission oil heat exchanger (24) starting from a predefined coolant temperature for heating the transmission oil when the engine is warmed up and directing coolant from the low temperature region (23) of the air/fluid cooler (21) through the transmission oil heat exchanger (27) when the transmission oil needs cooling, and said third flow control unit (27) further including a valve disk (26) with a bypass bore (34) through which, in a cooling phase, a limited amount of coolant returning from a heating circuit line (12) is permitted to flow back to the main coolant pump (1), while the flow control unit (27) directs the coolant flows from the low temperature region (23) of the air/fluid cooler (21) via the transmission oil heat exchanger (24) back to the main coolant pump (1).

2. The cooling and heating device as claimed in claim 1, wherein the third flow control unit (27) is a thermostat.

3. The cooling and heating device as claimed in claim 1, wherein a heating circuit line (12) is provided which is branched off from the coolant return line (10), and in which a heat exchanger (14) for heating the passenger compartment is arranged.

4. The cooling and heating device as claimed in claim 1, wherein an exhaust gas recirculation cooler (13) is arranged in the heating circuit line (12).

5. The cooling and heating device as claimed in claim 1, wherein the internal combustion engine (6) has two essentially separate coolant circuits, one in the engine block (8) and the other in the cylinder head (7), the coolant flow through the coolant circuits being controlled by the first flow control unit (3) depending at least on the of the coolant temperature, the coolant pressure, the combustion chamber temperature, the exhaust gas temperature, the exhaust gas values, the component temperature, the oil temperature, the passenger compartment temperature and the ambient temperature.

6. The cooling and heating device as claimed in claim 1, wherein the main coolant pump (1) is driven mechanically and includes a clutch (2) so that it can be switched on and off by means of the clutch (2).

7. The cooling and heating device as claimed in claim 1, wherein an electric additional coolant pump (16) is arranged in the heating circuit line (12).

* * * * *